United States Patent [19]

McKee et al.

[11] 4,214,803

[45] Jul. 29, 1980

[54] CONNECTOR CABLE CLAMP CONSTRUCTION

[75] Inventors: William H. McKee; Glenn W. Plummer, both of West Covina, Calif.

[73] Assignee: TRW Inc., Elk Grove Village, Ill.

[21] Appl. No.: 927,216

[22] Filed: Jul. 24, 1978

[51] Int. Cl.[2] ..... H01R 13/58

[52] U.S. Cl. ..... 339/103 R; 24/257; 339/223 R; 339/272 JC

[58] Field of Search ..... 339/103 B, 103 R, 91 R, 339/107, 223 R, 272 UC; 24/257

[56] References Cited

U.S. PATENT DOCUMENTS 4,127,315 11/1978 McKee ..... 339/103 B

*Primary Examiner*—Roy Lake

*Assistant Examiner*—DeWalden W. Jones

*Attorney, Agent, or Firm*—Neuman, Williams, Anderson & Olson

[57] ABSTRACT

A cable clamp particularly adapted for use with ribbon-type connectors is readily mounted on a connector end by means of a clamp anchor portion connected to a cable-supporting base having a projecting rib. Integral opposed side walls are adapted to move inwardly relative to the base and clampingly urge a cable, containing wires to be terminated in the connector, against such base over the projecting rib which extends transversely to the cable axis. Each side wall includes laterally extending ear portions for urging engaged cable portions downwardly on either side of the base rib so as to deform the cable over the rib and assure a secure cable-clamp engagement. Such engagement enables the cable and the individual wires to resist movement relative to the clamp upon the exertion of axial forces thereon, thereby functioning as an efficient strain relief preventing disruption of terminations of the wire conductors within the connector.

20 Claims, 16 Drawing Figures

FIG. 3
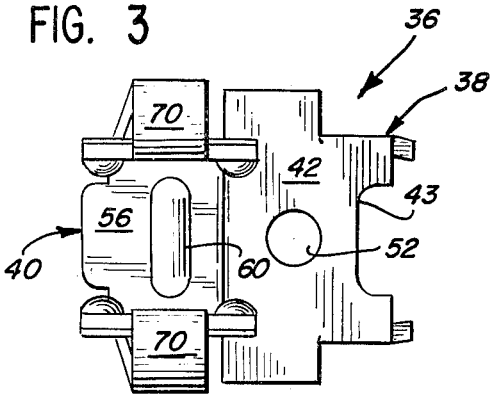
FIG. 4
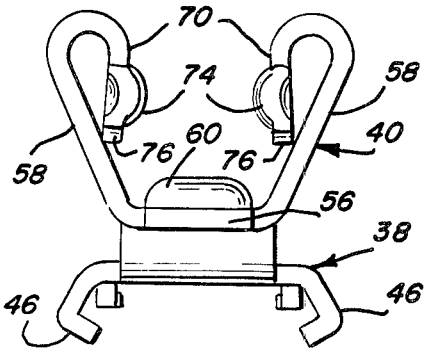
FIG. 5
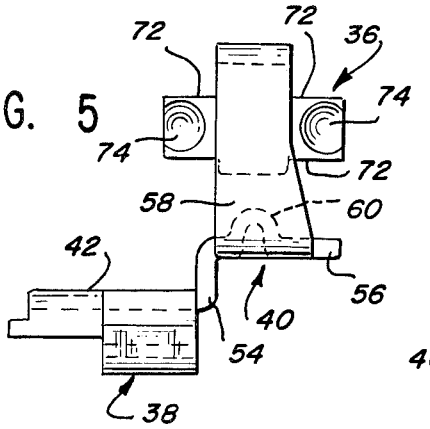
FIG. 7
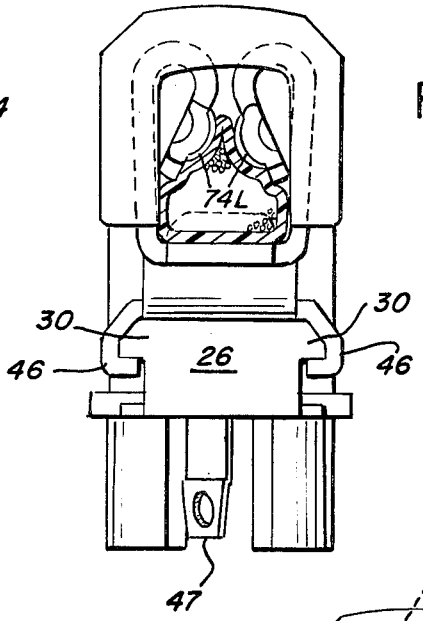
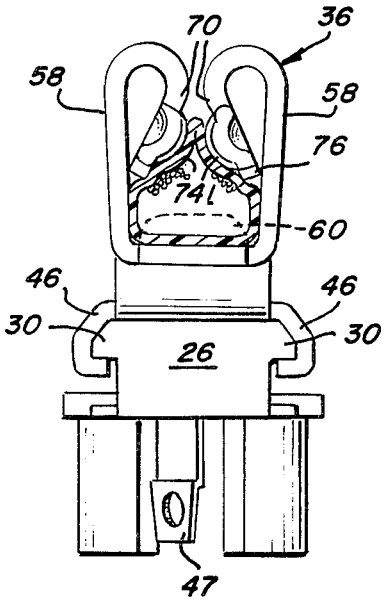
FIG. 6
FIG. 8
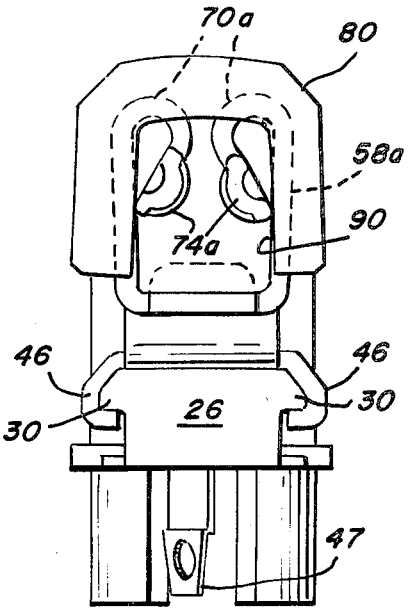

CONNECTOR CABLE CLAMP CONSTRUCTION

This invention relates to further improvements in cable clamps of the type described in McKee co-pending application Ser. No. 797,587, filed May 16, 1977, and in the prior co-pending application Ser. No. 797,588, of McKee and Witte, filed May 16, 1977.

This invention relates to a cable clamp construction, and more particularly pertains to a cable clamp for use with electrical connectors and more specifically for use with ribbon-type connectors.

The use of cable clamps with electrical connectors is well-known in the art. The clamps hereinafter described in detail are particularly adapted for use with ribbon-type connectors and termination systems. Such systems are commonly referred to as miniature ribbon termination systems or high density systems in which a plurality of wires are terminated in closely adjacent relationship. The individual wires may be connected to individual connector contacts by either solder-employing or solderless techniques.

Early prior art clamp constructions employed with electrical connectors incorporated cable clamps as an integral part of a hood construction. Utilizing such hood-clamp constructions, terminated wires of a connector are covered by a hood whereafter the cable from which the terminated wires emerge is clamped fixedly in place relative to the hood-connector assembly. As a result, axial forces applied to such cable will be reacted to at the point of clamp engagement with the cable, avoiding undesired stress from being applied to individual wire connections within the connector.

A typical prior art connector cover construction employing a strain relief comprising a cable clamp as an integral part thereof is disclosed in Ayer U.S. Pat. No. 3,876,276. Steinbach U.S. application Ser. No. 672,643, filed Apr. 1, 1976 discloses connector hood constructions in which cable clamps integrally formed with said constructions allow cable entry at the hood end or center. In each of these prior clamp constructions the individual wire-contact connections in the connector are hidden from view at the time the hood is fixed in place relative to the connector. Thus in these prior cable clamp constructions wires are terminated in the connector whereafter the cable is clamped in place. However, at the instant the cable is clamped, the condition of the wire terminations cannot be visually examined.

In Witte and McKee co-pending U.S. patent application Ser. No. 797,588, filed May 16, 1977, cable clamp constructions are provided in which deformable cable-engaging clamp elements extend from a base which is clamped directly on a connector end portion. Thus at the instant of cable engagement all wire terminations within the connector on which the clamp is mounted are clearly visible. If additional protection for the terminations is desired, a hood may subsequently be secured to the connector with the wires desirably terminated in the connector contacts, and the cable from which the wires extend locked in place so as to effect a strain relief function.

In McKee co-pending U.S. patent application Ser. No. 797,587, a cable clamp construction is provided also comprising a clamp anchor portion secured directly to a connector end portion. Cable-engaging clamp portions are provided comprising spaced clamp elements at least one of which is bendable toward the other to effect a clamping engagement with an interposed cable resting on a clamp base or floor from which the clamp elements extend at opposed edges. To increase cable retention properties of such clamps when the cables are subjected to axial pull, a projecting rib is disposed on the clamp floor, and cable-engaging dimples are formed on the clamp elements. The rib is arranged transversely to the axis of the cable supported thereon over which the cable is adapted to be restrained against axial movement by the opposed clamping elements which squeeze the cable therebetween.

In McKee's prior cable clamp arrangement of ribs and dimples, the clamp dimples were arranged two on one clamp element opposed to one dimple element on the opposed clamp element. The single dimple of McKee's prior construction was disposed in alignment with the rib axis and the two opposed dimples were disposed on opposite sides of the rib. Although serving to form a bind in the bottom cable wires immediately disposed over the clamp rib, the dimples did not force all the cable wires downwardly on opposed sides of the rib. This was due to the location of the dimples at the cable sides rather than over the cable top in the normal clamping position, and also due to the small degree of downward force resulting from the dimples disposed in staggered relation on the opposed clamping elements adjacent the transverse rib.

In accordance with this invention it is an object to significantly increase the slip resistance or resistance to axial forces of the clamped cable and of the individual wires within the cable sheath before relative movement between the wires and clamp results. Such increased resistance is afforded by providing a novel clamping side wall or "clamp arm" design.

It is another object of this invention to provide a cable clamp construction adapted to be directly mounted on a connector end portion which effects maximum cable-retaining properties despite the use of minimum material of formation, due to a unique structural design.

It is another object of this invention to provide an improved cable clamp construction of improved cable and wire-retention ability and which is readily mounted in place on a connector end and readily engaged with a cable peripheral portion by means of a simple bending action as may be effected by means of a pliers or the like.

It is a still further object of this invention to provide a tapered nose connector construction and mating hood construction of a length adapted to occupy a minimum of space in installations in the field.

The above and other objects of this invention will become apparent from the following description when read in the light of the drawing and the appended claims.

In one embodiment of this invention a clamp comprises an anchor portion adapted to be readily secured to a connector end portion as by means of a simple edge-clamping operation or the like. A clamping portion connected to and offset from the anchor portion includes opposed bendable clamping arms of substantially T-shaped configuration which are adapted to clamp therebetween a cable resting on a base or floor portion interposed the clamping arms. The transversely extending cross arms of the clamping arm T are divergent in the direction of the cable. Each cross arm may have a projection formed therein facing the opposed clamp arm for improved cable-retention purposes. Extending transversely to the centers of the clamping arms is a raised rib-like projection formed in the floor. Thus, upon urging at least one of the clamping arms toward the other and toward the floor so as to clampingly engage a cable therebetween, the cross arms diverge from the center post of the T of each clamping arm so as to protrude into the cable. The cross arms force cable portions and the wires contained therein to bendably deform over the underlying transverse rib. As a consequence, axial forces imparted to the clamped cable and contained wires will be resisted by the locking action effected by the deformed wire portions disposed to either side of the transverse ribs as will hereinafter be explained in greater detail.

By way of further example, the necessary cable retention may be obtained by the use of spaced clamp portions having projections, such as indicated in FIG. 5, or by divergent clamp portions having no projections, such as illustrated in FIG. 11, or by divergent portions also having projections, such as in FIG. 12.

For a more complete understanding of this invention reference will now be made to the drawings wherein.

Figure 2:
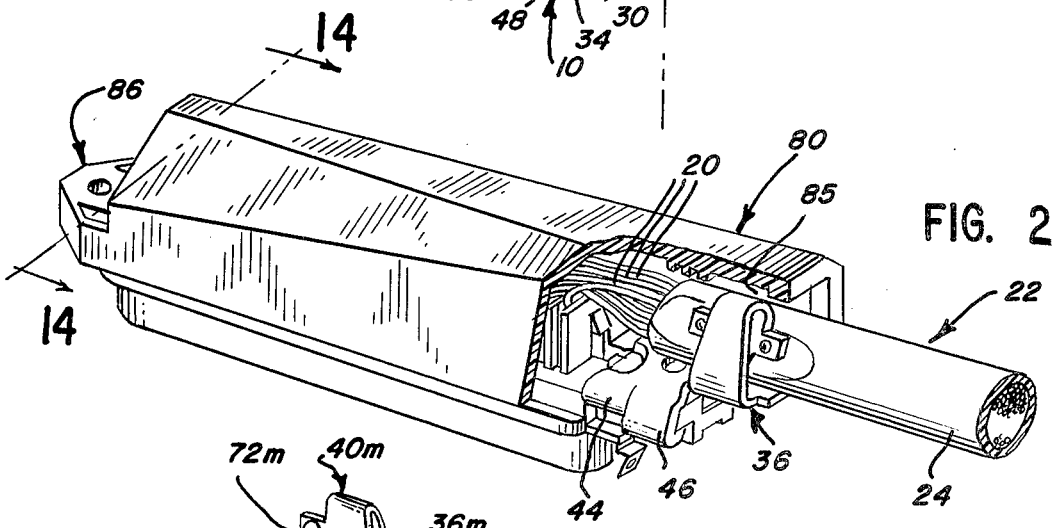
FIG. 2 is a perspective view, partly broken away, illustrating the elements of FIG. 1 in a normal position of assembly.
Figure 2A:
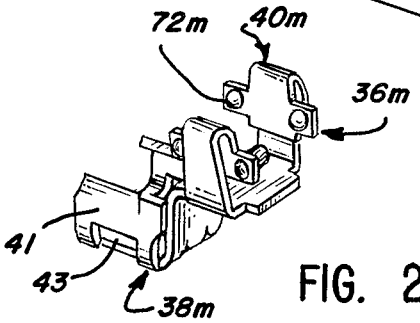

FIG. 2*a* is a perspective view of an embodiment of a clamp construction made pursuant to this invention and adapted to be mounted on a ribbon-type connector having a metal shell reinforcement.

Figure 1:
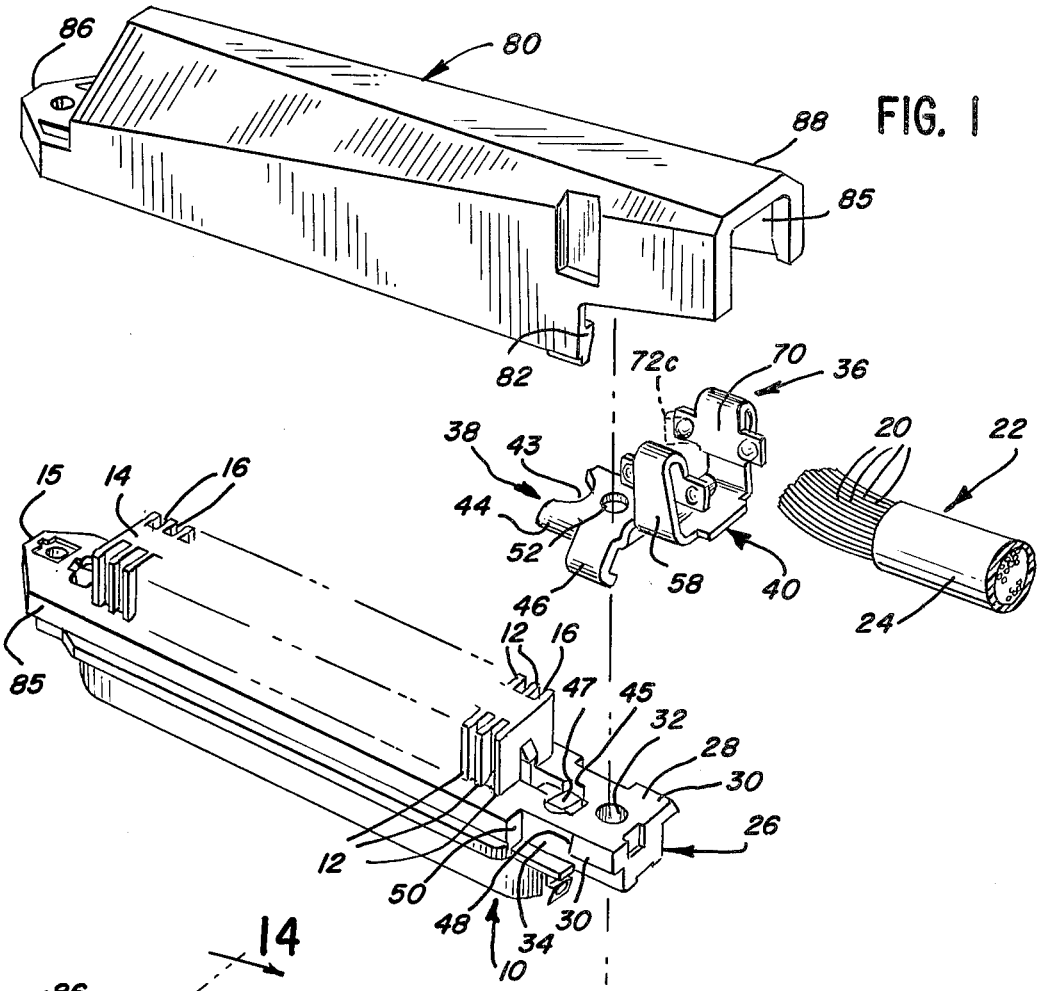
FIG. 1 is an exploded perspective view illustrating an all-plastic-body ribbon-type connector, a cable clamp made in accordance with this invention adapted to be mounted on one connector end and a hood adapted to envelope and mate with the connector and clamp after they have been assembled.
Figure 9:
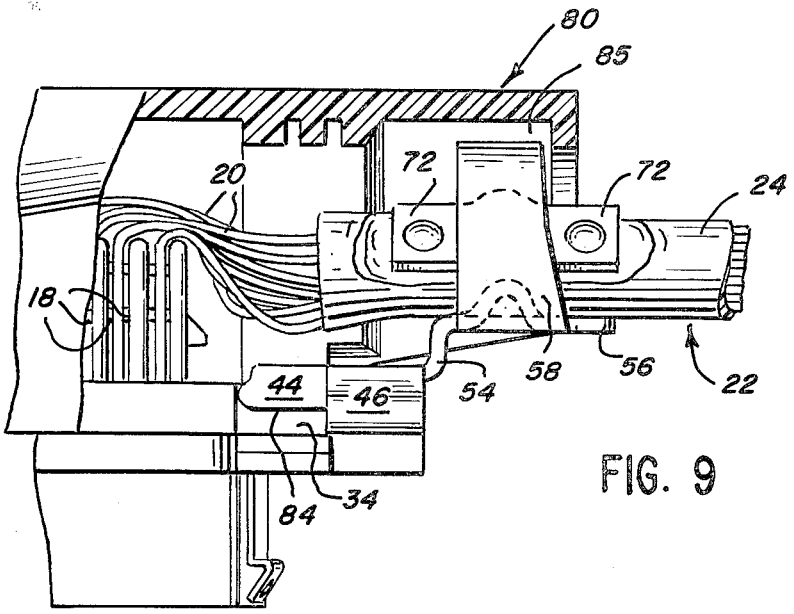
Figure 10:
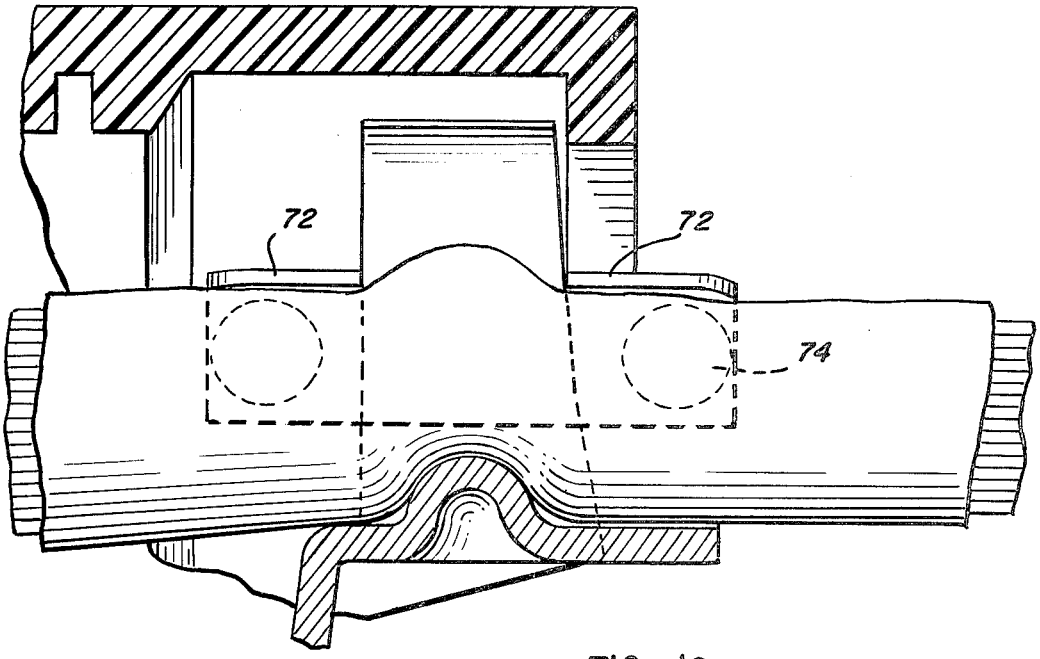
Figure 11:
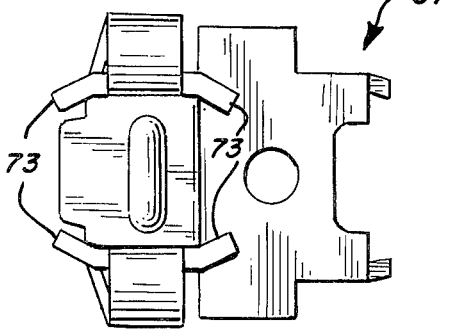
Figure 12:
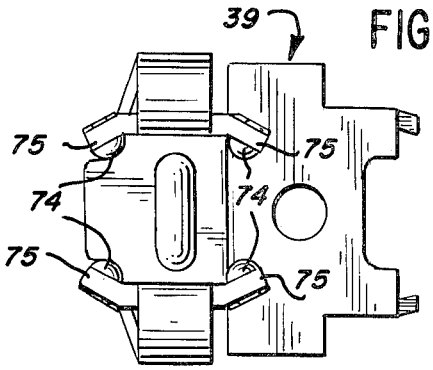
Figure 14:
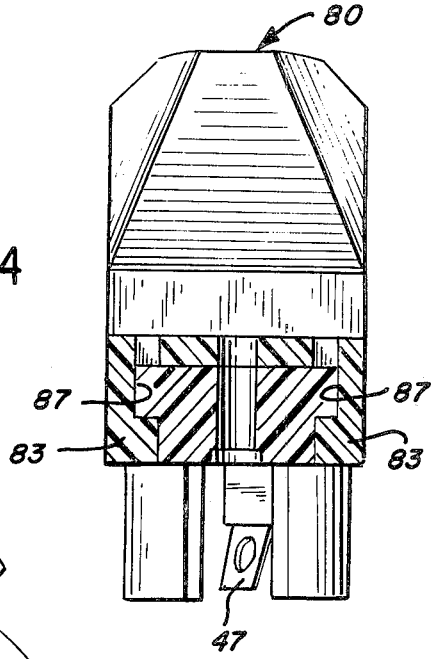
Figure 13:
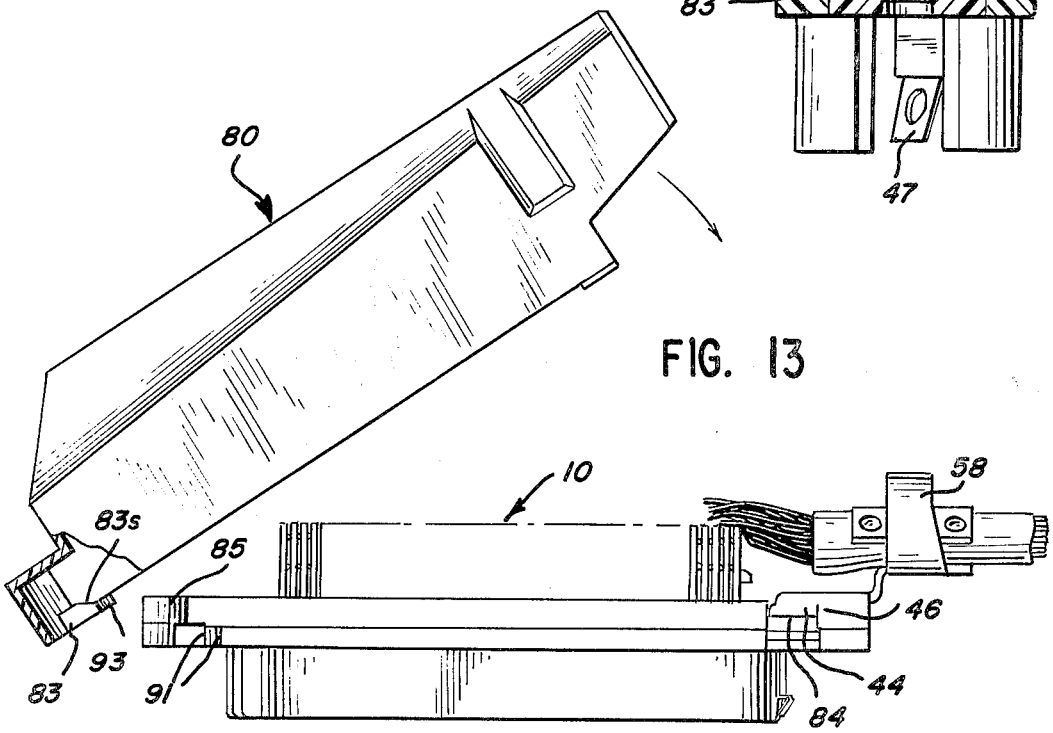

FIG. 3 is a top plan view of the cable clamp of FIG. 1 illustrated on an enlarged scale;

FIG. 4 is an end elevational view of the cable clamp illustrated in FIG. 3;

FIG. 5 is a side elevational view of the cable clamp of FIG. 3;

FIG. 6 is an end elevational view of the clamp and connector of FIG. 1 in a normal position of assembly;

FIG. 7 is an end elevational view of the elements of FIG. 1 in a normal condition of assembly;

FIG. 8 is a view similar to FIG. 7 illustrating another clamp construction in a position of assembly with the connector and hood of FIG. 1;

FIG. 9 is a side elevational view of the clamp end portion of the assembly of FIG. 2;

FIG. 10 is an enlarged sectional view partly in elevation further illustrating the manner in which termination wires are deformed and locked by a cable clamp made in accordance with this invention;

FIG. 11 is a perspective view of a modified cable clamp made in accordance with this invention having no projections in divergent clamping arms;

FIG. 12 is a perspective view of a second modified cable clamp having both divergent cross arms and projections formed therein;

FIG. 13 is a side elevational view partly broken away of the hood and connector clamp assembly of FIGS. 1 and 2 in their preliminary positions prior to effecting an interlocking engagement;

FIG. 14 is a sectional view taken on line 14—14 of FIG. 2; and

Figure 15:
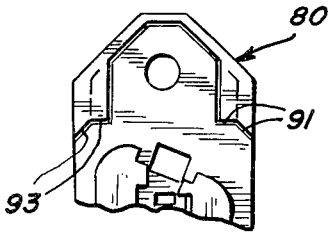

FIG. 15 is a fragmentary bottom plan view of the left end of the assembly of FIG. 2.

Referring now to FIG. 1 a connector 10 is therein illustrated which is composed of an electrically insulating plastic such as a polyester material which is glass-filled for strength purposes. Typical constructions of such connectors are disclosed in McKee co-pending applications Ser. No. 736,895, filed Oct. 29, 1976 and Ser. No. 797,587, filed May 16, 1977.

The illustrated connector 10 is of the type manufactured by TRW Inc. of Elk Grove Village, Ill. and referred to as a Cinch Superibbon Connector. Other connectors of similar types are also manufactured by a number of other manufacturers. All are adapted to be employed in so-called miniature termination systems, or high density systems in which a plurality of wires are terminated in close relationship to one another.

It will be noted from FIG. 1 that the illustrated connector receptacle 10 has a plurality of opposed barriers 12 extending from a central rib portion 14. Channels 16 defined by barriers 12 house metallic contacts 18 (see FIG. 9) adapted to engage wires in electrical connection such as wires 20 of cable 22 covered by resilient plastic sheath 24. The individual wires 20 of cable 22 may be connected to the individual contacts 18 by soldering or by a solderless technique which may employ any of a variety of terminating tools known in the art. In the illustrated connector 10, these connections are effected by the solderless techniques, as the cable wire retention function is very important in such connectors.

Prior to or after the wires 20 of cable 22 have been terminated in channels 16 of connector 10, the cable 22 may be clamped in relatively immovable relationship with connector 10 by a clamp 36 mounted on an end portion 26. The end portion 26 has an upper planar portion 28 from which extend at opposed lateral edges beveled ear portions 30. An aperture 32 is substantially centrally disposed in the connector end portion. Disposed inwardly of the beveled ears 30 are oppositely disposed planar edge portions 34, one of which is clearly seen in FIG. 1.

Cable clamp 36 is particularly adapted to be mounted on end portion 26 of connector 10 and comprises an anchor portion 38 integrally formed with a clamp portion 40. Anchor portion 38 has a central base 42 and downwardly extending inner lateral edge portions 44 and outer lateral edge portions 46. Base 42 is arcuately relieved at 43 (see FIGS. 1, 2 and 3) so that opening 45 of connector 10 (FIG. 1) may be exteriorly accessible for replacement if necessary of removable latch 47 (FIGS. 6–8). Such removable latches are described in McKee copending application Ser. No. 736,942, filed Oct. 29, 1976.

The clamp edge portions 46 are of generally C-shaped sectional configuration. In the normal position of assembly with a connector 10, the lateral edge portions 44 are clamped over opposed upper portions of connector edge surfaces 34 in the manner more clearly seen in FIGS. 2 and 9. Such clamping is effected by bending or clinching of the portions 44 after the outer lateral edge portions 46 are slidably engaged over the opposed ears 30 of the connector end 26 on which the cable clamp 36 is mounted. Inner shoulder 48, see FIG. 1, of each connector ear 30 functions as a locating surface for the portions 44 as does an opposed shoulder 50 extending at right angles to the planar surface portion 34 of the connector end 26. Accordingly, after the cable clamp lateral edge portions 44 are clamped into gripping engagement with the opposed upper edges of the connector surfaces 34, clamp 36 is prevented from moving in either axial direction by means of the stop surfaces 48 and 50.

It will be noted from FIG. 3 that a central aperture 52 may be disposed in base 42 of clamp anchor portion 38. A discrete securing means such as a screw may be employed through aperture 52 and aligned aperture 32 to interconnect the connector and clamp. If it is desired, such a securing means will permit ready disassembly of the clamp from the connector and dispense with the need of clamping the opposed lateral edge portions 44 of the clamp into engagement with the connector planar surfaces 34. The aperture 52 also may be employed with such a securing means when clamp 36 is utilized with a connector differing in construction from that of connector 10. Also, discrete securing means such as a nut and bolt may add additional rigidity to the clamp-connector assembly if it is desired to employ such securing means in addition to the clamping edge portions 44 of the cable clamp.

It will be most clearly seen from FIGS. 5 and 9 that base portion 42 of cable clamp 36 has integrally formed therewith at its outermost edge (in the normal position of assembly with connector 10), a substantially S-shaped connecting segment 54 which also integrally joins cable-support floor or base 56 of clamp portion 40.

The base 56 of clamp portion 40 is integrally formed at opposed lateral edges with upwardly diverging clamping walls or arms 58, see FIG. 4. The base also has a detent rib or raised deformation or projection 60 formed across a substantial portion of the width of clamp floor 56 transversely disposed to the mid-points of the opposed arms 58. Each clamping arm 58 has an inner reverse bend portion 70 which is of substantially T-shaped configuration as is most evident from FIGS. 1, 5, 9 and 10 of the drawing. Each lateral segment 72 of the cross member of the portion 70 has an inwardly formed projection in the form of a spherical segment 74 disposed therein which faces an opposed projection 74 of an exposed clamping arm 58 as is seen most clearly in FIGS. 3 and 4.

It will be noted from FIGS. 4 and 7 that terminal central finger 76 of each reverse bend portion 70 defines a stop for abutting the inner planar portion of the respective clamping arm 58 thereby locating the projections 74 relative to that arm. The significance of such projection location will hereinafter become more apparent.

In accordance with this invention the clamping arm projections 74 co-act with raised rib 60 on the clamp floor 56 to provide a novel cable-locking action of superior retention properties with desired high cable and wire resistance to axial pulling forces. Arms 72 may be horizontally disposed with projections 74 formed therein as seen in FIG. 1, or for cable retention purposes the arms may be divergently disposed as are arms 73 of clamp 37 illustrated in FIG. 11 with no projections formed therein. As a third embodiment the arms may be divergently disposed as are arms 75 of connector 39 in FIG. 12 with projections 74 formed therein. All three embodiments will function to provide desired cable retention functions. The following description specific to the claims of FIG. 1 will also be descriptive of the manner of using the three clamps.

In the normal course of clamp use, clamp 36 is securely mounted on a connector end portion in the manner previously described to form a connector and clamp subassembly. This may be a part of the connector production process. In the subsequent termination operation, the cable 22 from which the wires emanate is disposed over the transverse rib 60 of clamp 36. Either prior to or after the individual wires are terminated in the contacts 18, the clamping arms 58 are urged from the divergent position of FIG. 4 into the substantially parallel disposition of FIG. 6. As noted from FIG. 6, inward movement of arms 58 simultaneously deforms the peripheral portions of the cable sheath 24 where engaged by the clamping arms reverse bend portions 70 as the projections 74 force the wires 20 to be deformed downwardly on opposite sides of rib 60 as is most clearly seen in FIGS. 9 and 10, whereby the wires within the cable are bent into a tortuous path or crimped configuration, being bent over the rib 60. Thus, high axial pulling forces exerted on the cable 22 will not result in slippage of the individual wires 20 relative to the clamp 36, imparting a highly efficient strain relief ability to the clamp. Axial pulling forces imparted to the cable wires would require a sliding movement of the deformed and locked wire segments formed on the side of rib 60 disposed adjacent the connector 10, over the rib surfaces before any wire movement tending to break contact engagement could take place.

The novel wire-locking action effected by the co-action of the clamp transverse rib 60 and projections 74 enables the clamping arms to be of reduced internal strength as compared to my prior design. Thus, the width of the clamping arms may be relatively narrow, resulting in a savings in the material of fabrication for such clamp and reduced length of the hood and of the resulting overall connector assembly.

It will be noted from FIGS. 6 and 7 of the drawing that spherical projecting surfaces 74 have substantial lower arcuate surface portions 74L which function to urge the underlying cable portion and wires therein directly downwardly without gouging or cutting. It will be seen from FIGS. 4 through 7 that the projecting spherical surfaces have diameters substantially equal to the width of the lateral segments 72 in which disposed and thus comprise the maximum size spherical projection which may be formed therein. Thus, in the course of clamping cable 22 the projecting surfaces 74 in the course of moving from FIG. 4 to FIG. 6 will have the lower surface portions thereof 74L exert downward force components on wires spaced to either side of rib 60.

In the clamp embodiment 37 of FIG. 11 the lower and end cable-engaging edges of planar projecting arms 73 themselves exert downward force components on the cable. Accordingly, such edges are preferably formed with no sharp corners to avoid cutting of the engaged cable in the course of an inward movement.

Arms 75 of connector 39 of FIG. 12 are both divergent and have projections 74 formed therein and provide a wirebending action greater than clamps 36 or 37 because of the greater deformation of the cable periphery. The remaining structure of the cable clamps 37 and 39 of FIGS. 11 and 12 is the same as that of clamp 36 above described.

The projections 74 on the opposed sides of clamp 36 are spaced longitudinally of the connector from the rib 60, as best seen in FIG. 3. This spacing is adequate to assure bending of the wires in the cable on either side of rib 60 in the manner more clearly seen in FIG. 10. The intervals between the termini of arms 73 on the opposed sides of clamp 37 of FIG. 11 and between projections 74 of arms 75 of clamp 39 shown in FIG. 12 also are such as to assure desired wire bending on opposite sides of the rib 60.

The clamp retention dimples disclosed in McKee's earlier application Ser. No. 797,587 were not located on opposite rib sides in the manner of this invention, were not of adequate size to provide necessary downward force on the cable wires in the manner above referred to and were not laterally spaced adequate distances from the underlying clamp rib to assure wire deformation on either side of the rib rather than mere wire compression directly over the rib. The angular divergence formed in arms 75 of clamp 39 of FIG. 12 may be formed simultaneously with the formation of projections 74. The greater the deviation of the lateral arm segments of the connectors of FIGS. 11 and 12 from a planar relation, the greater the wire-bending force exerted on the cable 22 upon inward movement of the clamp sides.

It is intended that the above-described connector-clamp combinations be adapted for further combination with a hood such as hood 80 of FIG. 1. Hood 80 is adapted to extend over the width of the closed clamping arms 58 in the normal position of assembly, as is most apparent from FIGS. 9 and 10 of the drawings. During hood-connector engagement, slot defining detents 83 of the hood left end (FIG. 14) engage in a tongue and groove slidable interfit with ledge portions 85 defining in part the tapered end 15 of the connector 10 (see FIGS. 1, 13 and 14). The sectional view comprising FIG. 14 illustrates the nature of the snug interfit between the connector lateral ledge portions 85 and slots 87 defined by the hood detents 83. FIG. 13 illustrates the hood 80 and connector 10 in preliminary positions prior to being interlocked into the position of FIG. 2. The upper laterally projecting connector ledges 85 are guided by opposed inclined ramp or lead-in surfaces 83*a* (see FIG. 13) of the opposed detents 83. Such inclined surfaces permit a pivotal-slidable bayonet type fit at the left ends of the hood as illustrated in FIG. 13 whereafter the right end of the hood 80 may be pivoted downwardly. Angular stop shoulders 91 of the hood 10 engage mating shoulders 93 of the hood as illustrated in the bottom view of FIG. 15 when the engagement is complete.

The right end portions of the hood and connector engage by means of a snap-lock engagementk as inwardly projecting detents 82 of the hood (one of which is seen in FIG. 1) snap beneath lower edges 84 (see FIGS. 9 and 13) of clamp lateral edge portions 44. The hood includes an internal pocket 85 (FIG. 9) which receives and engages the clamp arms 58 to provide further support for the clamps 36. The hood 80 thus is of a type disclosed in McKee co-pending application Ser. No. 797,587, filed May 16, 1977, differing slightly from hood embodiments disclosed in such application by utilization of the tapered nose design at end 86 opposite to end 88 housing the clamp 36. Such tapered end accommodates mating tapered end 15 of connector 10 as above described. The tapered configuration of the connector nose 15 and hood 86 provide room in a housing box or the like which enables screws or similar connectors to be located immediately adjacent either side of the tapered nose 86.

An advantageous feature of the novel clamp discussed above comprises the fact that in addition to possessing superior cable and wire-gripping properties, not only may the width of the clamping arms 58 be retained at a desired minimum, but in addition the length of the connector hood portion housing the connection may similarly be reduced. Accordingly, attendant savings are realized in the manufacture of the hood 80 as well as in the manufacture of the clamp 36. The reduced length of the hood-clamp-connector assembly is a desirable feature in field applications where minimum space is available. Thus, the provided clamp, due to its superior retention properties, is able to maintain at a minimum the hood length which determines the space occupied by the elements of FIG. 1 in assembled relation.

The clamp 26 is preferably formed of a deformable, low carbon steel having very low or no resiliency which permits the arms 58 to maintain a desired clamping position after bending the arms into the position of FIG. 6. That is, the material should be of a yield strength and ductility to be bent into engagement with the cable and thereafter to maintain the clamping engagement by the internal forces generated within the arms to retain the cable and wire without auxiliary securing means. A suitable material of composition for use in clamp formation comprises AISI 1010 annealed steel in sheet or coil form of approximately 0.047 inch thickness from which clamp blanks may be punched. The bending operations necessary to form the clamp arms about the cable and crimp the clamp anchor portion the connector edges may be readily carried out, e.g., by a plier-type tool.

The arms 58 may be divergently formed as illustrated in FIG. 4 for purposes of readily receiving a cable 22, after which both arms are inwardly bent to a vertical or approximately vertical position of FIG. 8. Other angular relationships betwen arms 58 may be initially assumed. Thus, one arm may initially be at an angle of 90° relative to the base 56 and the opposed arm at a greater obtuse angle than that illustrated in FIG. 4. A particular angular relationship may adapt itself to automatic clamping apparatus. The provided clamp is particularly well-suited for use with automated assembly operations as no discrete securing means are necessary for securing the clamp to a cable but merely an arm bending action which may be effected by a pair of closing jaws.

As above noted, terminal ends 76 of the clamping arms 58 locate the spherical projecting surfaces 74 relative to the planar inner portion of each clamping arm 58 as seen in FIG. 4. If the reverse bend portions 70 were formed as are portions 70*a* illustrated in FIG. 8, peripheral edge portions of projections 74*a* could approach portions of each clamping arm 58*a* so as to engage a rear edge portion 90 of hood 80 and interfere with the clamp insertion onto the hood. In this regard, it will be noted from FIG. 9 that although an arm portion 50 of each arm 58 is located and engaged within the hood, a portion of the cross arm portion 72 will be disposed exteriorly of the hood.

By way of exemplary dimensions, a clamp 36 of metal stock as noted above and adapted to engage connectors of TRW, Inc. sold under the name SUPERIBBON may have an anchor base portion 42 of a width of 0.48" with depending flanges 44 of approximately 0.060". The transverse rib 60 formed in floor 42 of the clamp may be 0.065" high above floor 56 and 0.25" long and 0.11" wide. Each arm 58 may be about 0.178" wide, with a taper to a width about 0.05" wider at the base, see FIG. 5. Each arm 72 may be about 0.145" wide and extend outwardly about 0.125" from the arm portion 70, with the respective projection 74 centered 0.09" from portion 70, the projections 74 thus being spaced about 0.36" on centers. Each projection 74 may protrude approximately 0.05 inch from the respective arm 74. The projection-locating terminal 76 need be only 0.03 inch in length. Such a clamp provided satisfactory retention of a 50-wire cable.

It is apparent that dimensions and structural details of the above-described clamp may be altered to serve particular applications. Thus, although the foregoing description has been specific to a clamp 36 adapted to be mounted on an all-plastic female connector 10, the clamp 36 is, of course, equally well-adapted to be mounted on the end of a corresponding mating connector plug. A modified clamp **36*m* of FIG. 1A may be employed for mounting on a ribbon-type connector having a metal shell reinforcement. Clamp 36*m* differs from clamp 36 mainly in the structure of the anchor portion 38*m* which possesses side walls 44 having slots 43 for reception of hood detents and is secured to a connector end portion by means of a rivet or the like rather than by clamping edge portions. Such a clamp engagement with a connector having a metal shell is disclosed in McKee co-pending application Ser. No. 797,587. The clamp portion 40*m* of clamp 36*m*, however, is the same as clamp portion 40 of clamp 36**.

It is thus seen that a novel clamp construction has been provided. Despite an approximately 50% reduction in the width of the clamping arms from the width heretofore believed necessary, an engaged cable and wires disposed therein are able to resist high axial pulling forces by novel coaction between a clamp raised projection and spaced clamp portions which may be planar or have projections of spherical configuration which apply pressure on the cable at widely spaced points and thereby deform cable wires on opposite sides of the projection to effect a wire crimp-type lock. The wires are bent or kinked over the projection to provide a firm gripping lock of the wires in the clamp. The transverse arms of each side may be parallel or in diverging relation. The projections may have configurations other than spherical, the only criterion being that the desired wire bending action result. In the following claims "cable" is intended to encompass not only a plurality of wires having a surrounding sheath, but also a plurality of generally parallel wires per se.

The provided clamp is able to provide more efficient clamping action, enabling the assembly to be of shorter overall length and thereby to be usable in small spaces, while simultaneously reducing the cost of clamp and hood manufacture.

It is apparent from the above that a number of modifications may be made in the constructions abovedescribed which remain within the ambit of the invention described. This invention, therefore, is to be limited only by the scope of the appended claims.

What is claimed is:

1. A cable clamp for use with an electrical connector comprising means for anchoring said clamp to a connector end portion; opposed clamping means integrally joined with the anchor means for clampingly engaging a cable therebetween; at least one of said clamping means being deformable toward the other; each of said clamping means having spaced facing portions projecting in the general direction of the opposed clamping means; a floor portion interposed said clamping means having a projection; said spaced facing portions of each of said clamping means having portions disposed on opposite sides of and facing said projection for bending a cable between said projection and said spaced facing portions when said at least one clamping means is deformed toward the other of said clamping means.

2. The cable clamp of claim 1 wherein each of the projecting portions of the clamping means comprises a cable-engaging protuberance of rounded configuration.

3. A cable clamp for use with an electrical connector comprising means for anchoring said clamp to a connector end portion; opposed clamping means integrally joined with the anchor means for clampingly engaging a cable therebetween; at least one of said clamping means being deformable toward the other; each of said clamping means having spaced facing portions projecting in the direction of the opposed clamping means; a floor portion interposed said clamping means having a projection; each of said facing portions comprising cross arms extending from an interposed wall portion; said cross arms of each facing portion being divergent in the direction of the opposed clamping means for bending a clamped cable between said projection and said spaced facing portions.

4. The cable clamp of claims 1 or 3 wherein said floor portion is in parallel relation with the anchoring means and at a different level in the vertical plane.

5. The cable clamp of claims 1 or 3 wherein each of said clamping means is formed of a material having a yield strength and ductility to be bent into engagement with such cable and thereafter to retain such cable without use of auxiliary securing means.

6. The cable clamp of claims 1 or 3 in which each cable clamping means comprises a deformable clamp member connected to said floor portion and adapted to move over said floor portion and urge an engaged cable peripheral portion toward said floor portion.

7. A cable clamp for use with an electrical connector comprising an anchor portion for mounting said clamp on an end portion of such connector; a cable clamp portion connected to said anchor portion for clampingly engaging a cable comprising wires to be terminated in such connector; said clamp portion including a floor having a transverse projection formed therein; opposed, cable-engaging clamping means extending from opposed edges of said floor at opposed ends of said projection and bendable into a substantially vertical cable-clamping position; each of said clamping means having lateral ears facing toward and disposed on opposite sides of said projection for engaging and bending a cable disposed between said projection and said laterally projecting ears when said clamping means are bent into said vertical cable-clamping position.

8. The cable clamp of claim 7 in which each of said clamping ears has a spherical segment projecting in the direction of the opposed clamping means; said segments having surface portions facing said floor when said clamping means are in the substantially vertical position.

9. A cable clamp for use with an electrical connector comprising an anchor portion for mounting on a connector end portion and including a base having lateral depending edges deformably movable toward each other for clampingly engaging an interposed connector end portion; opposed, depending, channel-defining edge portions disposed adjacent said lateral edge portions; a clamp portion joined to said anchor portion comprising a floor disposed generally parallel to said base and in a plane spaced therefrom; opposed clamping means deformably movable toward each other and extending from opposed edges of said floor for clampingly engaging a cable therebetween; a projection disposed in said floor between said clamping means; each of said clamping means having spaced portions extending toward the opposed clamping means; said portions of each clamping means being disposed on opposite sides of and facing said projection for bending a cable disposed between said projection and said spaced facing portions when said clamping means are deformably moved toward each other.

10. The clamp of claim 9, in combination with an electrical connector comprising a body of electrically insulating plastic having a plurality of parallel channels; spaced parallel barriers defining said channels; wire engaging contact portions disposed in said channels; mating contact portions extending from said wire engaging contact portions in a direction opposite to said wire engaging portions; opposed end portions of said connector body having laterally projecting ears; one connector end portion having beveled terminal edge portions whereby said one connector end is substantially arrow shaped; the other connector end having planar surfaces disposed inwardly of the adjacent laterally projecting ears; said channel-defining edge portions of said cable clamp receiving said laterally projecting ears of said connector other end and said clamp depending edges clamplingly engaging said substantially planar surfaces whereby said clamp and connector are interlocked.

11. The combination of claim 10 in further combination with a connector hood for enveloping said connector barriers, and wire engaging contact portions disposed thereon; said hood having opposed wall portions joined at first ends and being relatively movable at the opposed ends; said hood joined ends being contiguous with an arrow shaped extension defining interior slots for receiving said connector laterally projecting ears at said one end in a slidable interlock; said hood walls relatively movable ends having inwardly projecting detents for engaging distal edge portions of said clamp depending edges in an interlocking engagement at the connector end opposite to said one end.

12. The combination of claim 11 in which said hood interior slots are defined by opposed inwardly projecting detents having beveled lead-in end surface portions.

13. A cable clamp for use with an electrical connector comprising means for anchoring said clamp to a connector end portion; opposed clamping means integrally joined with the anchor means for clampingly engaging a cable therebetween; at least one of said clamping means being deformable toward the other; each of said clamping means having spaced facing portions projecting in the direction of the opposed clamping means; a floor portion interposed said clamping means having a projection; each of said facing portions comprising cross arms extending from an interposed wall portion; said cross arms of each facing portion being divergent in the direction of the opposed clamping means for bending a clamped cable between said projection and said spaced facing portions; each of said cross arms having a cable engaging protuberance of rounded configuration formed therein.

14. A cable clamp for use with an electrical connector comprising an anchor portion for mounting on a connector end portion and including a base having lateral depending edges deformably movable toward each other for clampingly engaging an interposed connector end portion; opposed, depending, channel-defining edge portions disposed adjacent said lateral edge portions; a clamp portion joined to said anchor portion comprising a floor disposed generally parallel to said base and in a plane spaced therefrom; opposed clamping means deformably movable toward each other and extending from opposed edges of said floor; a projection disposed in said floor between said clamping means; said clamping means having spaced portions extending toward the opposed clamping means; said portions of each clamping means being disposed on opposite sides of said projection; each of said clamping means spaced portions comprising cross arms diverging in the direction of the opposed clamping means.

15. The cable clamps of claim 1, 8, 10, 3, 13 or 14 in which each of said clamping means comprises an outer sidewall joined to a reverse bend inner portion, and means are disposed on each of said reverse bend inner portions for locating said projections relative to said outer sidewall.

16. The cable clamp of claim 14 in which said cross arms are planar.

17. The cable clamp of claim 14 in which said cross arms have hemispherical projections formed therein.

18. A cable clamp for use with an electrical connector comprising an anchor portion for mounting on a connector end portion; a cable clamp portion connected to said anchor portion adapted to clampingly engage a cable comprising wires to be terminated in such connector; said clamp portion including a floor having a transverse projection formed therein; opposed bendable cable-engaging clamping means extending from opposed edges of said floor at substantially right angles to the axis of said projection; each of said clamping means comprising an outer side wall joined to a reverse bend inner portion having divergent arms facing said projection; said arms having spaced projections facing in the direction of spaced projections of the opposed clamping means, and means on each of said reverse bend inner portions for locating said projections relative to said outer side wall.

19. The cable clamp of claim 18 in which the projection locating means comprises a terminal tab of each clamping arm reverse bend portion extending in the direction of said floor.

20. A cable clamp for use with an electrical connector comprising means for anchoring said clamp to a connector end portion; opposed clamping means integrally joined with the anchor means for clampingly engaging a cable therebetween; at least one of said clamping means being deformable toward the other; each of said clamping means having spaced facing portions projecting in the general direction of the opposed clamping means; a floor portion interposed said clamping means having a projection; said spaced facing portions of each of said clamping means having portions disposed on opposite sides of and facing said projection for bending a cable between said projection said spaced forming portions when said at least one clamping means is deformed toward the other of said clamping means; the anchoring means comprising a base having opposed side walls; opposed terminal ends of said sidewalls being inclined toward each other, and an end wall extending from said base and disposed between said sidewalls; said end wall being joined to said clamping means floor portion.

* * * * *